US010941973B2

(12) United States Patent
Kim et al.

(10) Patent No.: US 10,941,973 B2
(45) **Date of Patent: *Mar. 9, 2021**

(54) REFRIGERATOR

(71) Applicant: LG Electronics Inc., Seoul (KR)

(72) Inventors: Jaeyoung Kim, Seoul (KR); Seonil Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/868,234

(22) Filed: May 6, 2020

(65) Prior Publication Data

US 2020/0263917 A1 Aug. 20, 2020

Related U.S. Application Data

(63) Continuation of application No. 16/098,717, filed as application No. PCT/KR2017/004564 on Apr. 28, 2017, now Pat. No. 10,684,061.

(30) Foreign Application Priority Data

May 2, 2016 (KR) ..... 10-2016-0053885

(51) Int. Cl.
*F25D 23/02* (2006.01)
*F25D 23/06* (2006.01)
(Continued)

(52) U.S. Cl.
CPC ..... *F25D 23/025* (2013.01); *E05B 65/00* (2013.01); *E05C 3/06* (2013.01); *E05C 7/02* (2013.01);
(Continued)

(58) Field of Classification Search
CPC ..... F25D 23/02; F25D 23/06; F25D 23/025; F25D 23/028; E05C 3/06; E05C 7/02;
(Continued)

(56) References Cited

U.S. PATENT DOCUMENTS 8,801,124 B2 * 8/2014 Jung ..... F25D 23/04 312/405
2015/0069900 A1 * 3/2015 Lim ..... F25D 23/025 312/405
(Continued)

FOREIGN PATENT DOCUMENTS

KR 10-0165019 * 1/1999
KR 10-2015-0074233 * 7/2015
(Continued)

*Primary Examiner* — James O Hansen
(74) *Attorney, Agent, or Firm* — Fish & Richardson P.C.

(57) ABSTRACT

A refrigerator includes an opening unit such that, when a second door rotates to open a second storing chamber, the second door is separated from a first door. The opening unit includes: a latch hook to be selectively inserted into a latch slot on the front surface of the first door; a pressing portion provided on a door handle of the second door, the pressing portion comprising a guide protrusion having a sloping surface; and a link portion having a contact portion on one end to contact the sloping surface and move upward/downward along the sloping surface, the other end of the link portion contacting the latch hook. When the pressing portion is pressed, the contact portion moves upward along the sloping surface, and the other end of the link portion pushes the latch hook upward with the contact portion to separate the latch hook from the latch slot.

20 Claims, 8 Drawing Sheets

(51) Int. Cl.

| | |
|---|---|
| ***E05F 11/54*** | (2006.01) |
| ***E05B 65/00*** | (2006.01) |
| ***E06B 3/36*** | (2006.01) |
| ***E05C 3/06*** | (2006.01) |
| ***E05C 7/02*** | (2006.01) |
| ***E05C 19/12*** | (2006.01) |

(52) U.S. Cl.
CPC ..... *E05C 19/12* (2013.01); *E05F 11/54* (2013.01); *E06B 3/36* (2013.01); *F25D 23/02* (2013.01); *F25D 23/028* (2013.01); *F25D 23/06* (2013.01); *E05Y 2900/31* (2013.01); *F25D 2323/023* (2013.01)

(58) Field of Classification Search
CPC .. E05C 19/12; E05B 65/00; E06B 3/36; E05F 11/54
USPC ..... 312/401, 405, 405.1, 291, 321.5
See application file for complete search history.

(56) References Cited

U.S. PATENT DOCUMENTS

2015/0260443 A1* 9/2015 Lee ..... E05C 1/16 312/404
2016/0201976 A1* 7/2016 Choi ..... F25D 23/00 312/405

FOREIGN PATENT DOCUMENTS

KR 10-2015-0099024 * 8/2015
KR 10-2015-0106311 * 9/2015
KR 10-1575929 * 12/2015

* cited by examiner

REFRIGERATOR

CROSS-REFERENCE TO RELATED APPLICATIONS

This application is a continuation of U.S. application Ser. No. 16/098,717, filed on Nov. 2, 2018, which is a National Stage application under 35 U.S.C. § 371 of International Application No. PCT/KR2017/004564, filed on Apr. 28, 2017, which claims the benefit of Korean Application No. 10-2016-0053885, filed on May 2, 2016. The disclosures of the prior applications are incorporated by reference in their entirety.

TECHNICAL FIELD

The present invention relates to a refrigerator.

BACKGROUND ART

A refrigerator is a household appliance used to store food in a refrigerated state or a frozen state.

The refrigerator includes a main body, in which a storage compartment is formed, and a door movably connected to the main body to open or close the storage compartment.

The storage compartment may be divided into a refrigerating compartment and a freezing compartment, and the door includes a refrigerating compartment door for opening or closing the refrigerating compartment and a freezing compartment door for opening or closing the freezing compartment.

A user opens the freezing compartment door or the refrigerating compartment in order to take out food stored in the freezing compartment or the refrigerating compartment. When the door of the refrigerator is opened, the user pulls the door of the refrigerator open by strong force due to internal pressure of the refrigerator. Therefore, the user needs to grasp and pull the handle of the door by force.

In order to overcome such a disadvantage, Korean Laid-Open Publication No. 10-2013-0053318 discloses a refrigerator door having a latch open structure mounted in the handle of the door.

In the prior art, a second door is rotatably mounted on a front end of a first door for opening or closing a storage compartment of a refrigerator. In order to open the second door, a pressing button formed on the handle of the second door is pressed. When the pressing button is pressed, a pressing pin connected to the pressing button presses a latch member formed on the first door, thereby unlocking the second door.

However, the refrigerator of the prior art has the following problems.

First, in order to unlock the latch member, since a connector having the pressing pin accommodated therein and connecting the second door with the handle is formed, the appearance of the refrigerator is not clean due to the connector.

Second, when the user grasps the handle to open the door, since the hand grasping the handle interferes with the connector formed on the handle, it is inconvenient to open the door.

Technical Problem

An object of the present invention devised to solve the problem lies in a refrigerator capable of improving the appearance of the refrigerator, eliminating interference with a latch upon opening a door, and separating a first door and a second door from each other by simple operation.

Technical Solution

The object of the present invention can be achieved by providing a refrigerator including a cabinet in which a first storage compartment is formed, a first door rotatably connected to a front surface of the cabinet to selectively open or close the first storage compartment and including a latch slot formed in an edge of one side thereof, a storage device formed on a rear surface of the first door to form a second storage compartment, a second door rotatably connected to a front surface of the first door to selectively open or close the second storage compartment, a door handle formed on a front surface of the second door, and an opening unit configured to separate the second door from the first door when the second door rotates in order to open the second storage compartment.

In particular, the opening unit includes a latch hook provided on the second door to be selectively inserted into the latch slot, a pressing portion provided on the door handle and including a guide protrusion having an inclined surface formed on one side thereof, and a link portion having a contact portion formed on one end thereof to contact the inclined surface and to move upward and downward along the inclined surface, the other end of the link portion contacting the latch hook. When the pressing portion is pressed, the contact portion moves upward along the inclined surface, and the other end of the link portion pushes the latch hook upward together with the contact portion, such that the latch hook is separated from the latch slot.

Advantageous Effects

The refrigerator according to the embodiments of the present invention having the above configuration has the following effects.

First, since a latch structure for opening a door is not exposed to the outside, the appearance of the refrigerator is improved.

Second, when a user grasps a handle to open the door, interference with the latch structure does not occur.

Third, in a double door structure, it is possible to separate a first door and a second door from each other by only grasping the handle of the door, thereby improving user convenience.

BEST MODE

Hereinafter, a refrigerator according to an embodiment of the present invention will be described in detail with reference to the drawings.

Figure 1:
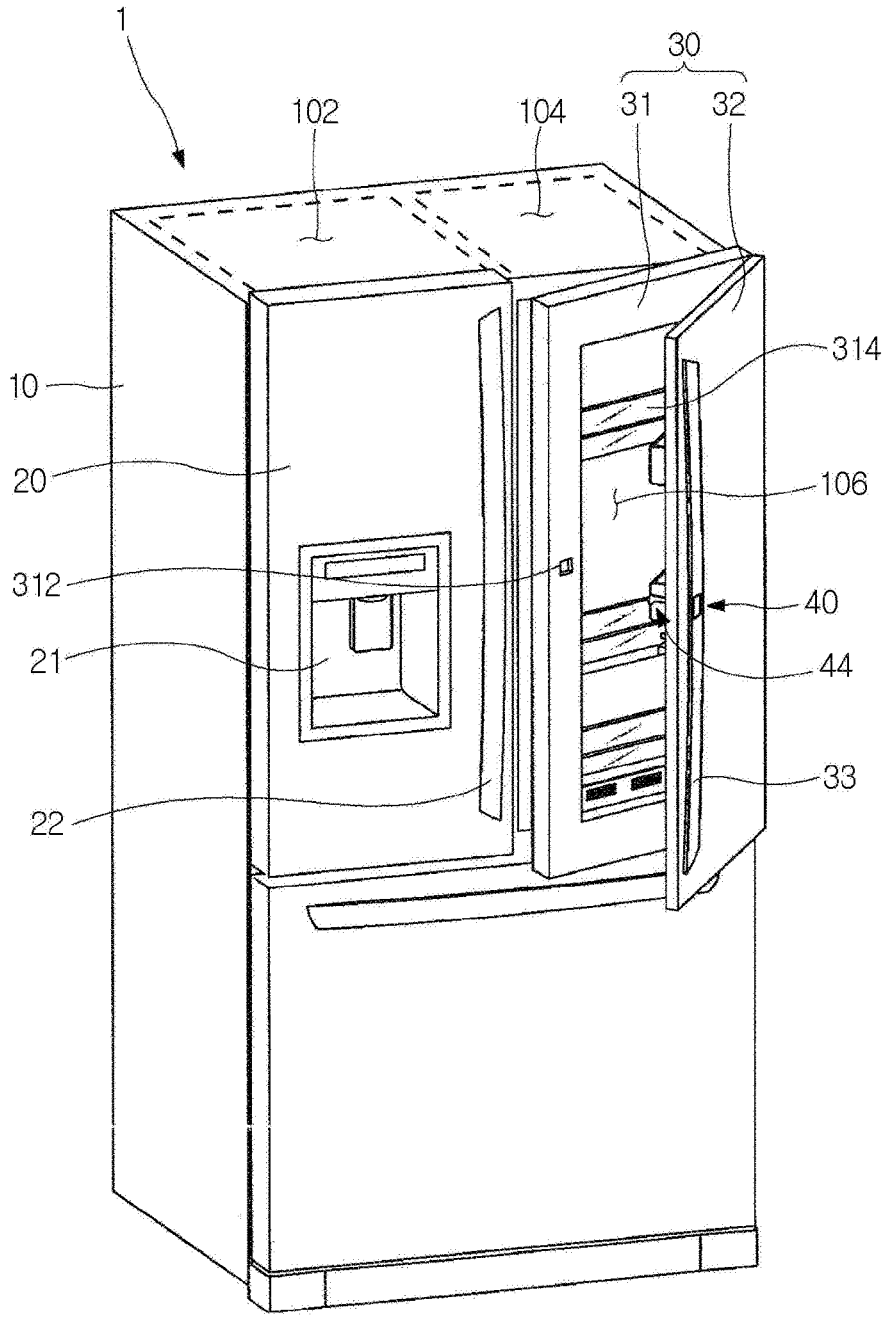
FIG. 1 is a perspective view of a refrigerator according to an embodiment of the present invention.

FIG. 1 is a perspective view of a refrigerator according to an embodiment of the present invention.

Referring to FIG. 1, the refrigerator 1 according to the embodiment of the present invention includes a cabinet 10, in which a storage compartment is formed, and doors 20 and 30 for opening or closing the storage compartment.

The storage compartment includes a freezing compartment 102 and a refrigerating compartment 104. The freezing compartment 102 and the refrigerating compartment 104 may be disposed side to side and may be partitioned by a partition.

The doors 20 and 30 may include the freezing compartment door 20 for opening or closing the freezing compartment 102 and the refrigerating compartment door 30 for opening or closing the refrigerating compartment 104.

The freezing compartment door 20 and the refrigerating compartment door 30 may be rotatably mounted on the front surface of the cabinet 10.

In addition, a sliding door slidably mounted on the front surface of the cabinet 10 may be formed below the freezing compartment door 20 and the refrigerating compartment door 30, in order to open or close a separate storage compartment.

A dispenser 21 for dispending water or ice may be provided in the front surface of the freezing compartment door 20, and a freezing compartment door handle 22 grasped by a user to open the freezing compartment door 20 may be provided on one side of the front surface of the freezing compartment door 20.

The refrigerating compartment door 30 includes a first door 31 rotatably mounted on the front surface of the cabinet 10 and a second door 32 rotatably mounted on the front surface of the first door 31, in order to open or close the refrigerating compartment 104.

Specifically, a storage device for storing food is provided on the rear surface of the first door 31. The storage device includes a frame 314 forming a storage space. The frame 314 is detachably coupled to the rear surface of the first door 31.

In a state in which the first door 31 closes the refrigerating compartment 104, the frame 314 is located in the refrigerating compartment 104. In the present embodiment, the refrigerating compartment 104 may be referred to as a first storage compartment and a space formed by the frame 314 may be referred to as a second storage compartment 106. Hereinafter, assume that the refrigerating compartment 104 is the first storage compartment 104.

Accordingly, in a state in which the first door 31 closes the first storage compartment 104, the second storage compartment 106 is located in the first storage compartment 104.

The first door 31 is rotatably connected to the cabinet 10 by a hinge assembly.

The hinge assembly may include a second hinge (not shown) connecting the first door 31 with the second door 32 and a first hinge (not shown) connecting the first door 31 with the cabinet 10.

An opening (108 of FIG. 3), which allows the food stored in the second storage compartment 106 to be put into or taken out in a state in which the first door 31 closes the first storage compartment 104, is formed in the first door 31. Accordingly, the opening 108 may be opened in a state in which the first door 31 closes the first storage compartment 104 to allow food to be put into or taken out from the second storage compartment 106.

A refrigerating compartment door handle 33 grasped by the user may be provided on one side of the front surface of the second door 32, in order to open the second door 32.

In addition, a latch hook 44 for coupling with the first door 31 is formed on the rear surface of the second door 32, and a latch slot 312, to which the latch hook 44 is coupled, is formed in the front surface of the first door 31.

The latch hook 44 may be selectively coupled to the latch slot 312. Accordingly, when the latch hook 44 is coupled to the latch slot 312, the first door 31 and the second door 32 rotate as one body by rotation of the second door 32, and, when the latch hook 44 is separated from the latch slot 312, the second door 32 independently rotates.

In the present embodiment, an opening unit 40 corresponding to a means for separating the latch hook 44 from the latch slot 312 is provided on one side of the refrigerating compartment door handle 33.

The opening unit 40 may move forward and backward by operation of the user to separate the latch hook 44 from the latch slot 312, and may be exposed through the front surface of the second door 32. Accordingly, when the opening unit 40 operates through the refrigerating compartment door handle 33, the latch hook 44 may be separated from the latch slot 312 to open the second door 32.

Hereinafter, the configuration of the opening unit will be described in detail with reference to the drawings.

Figure 2:
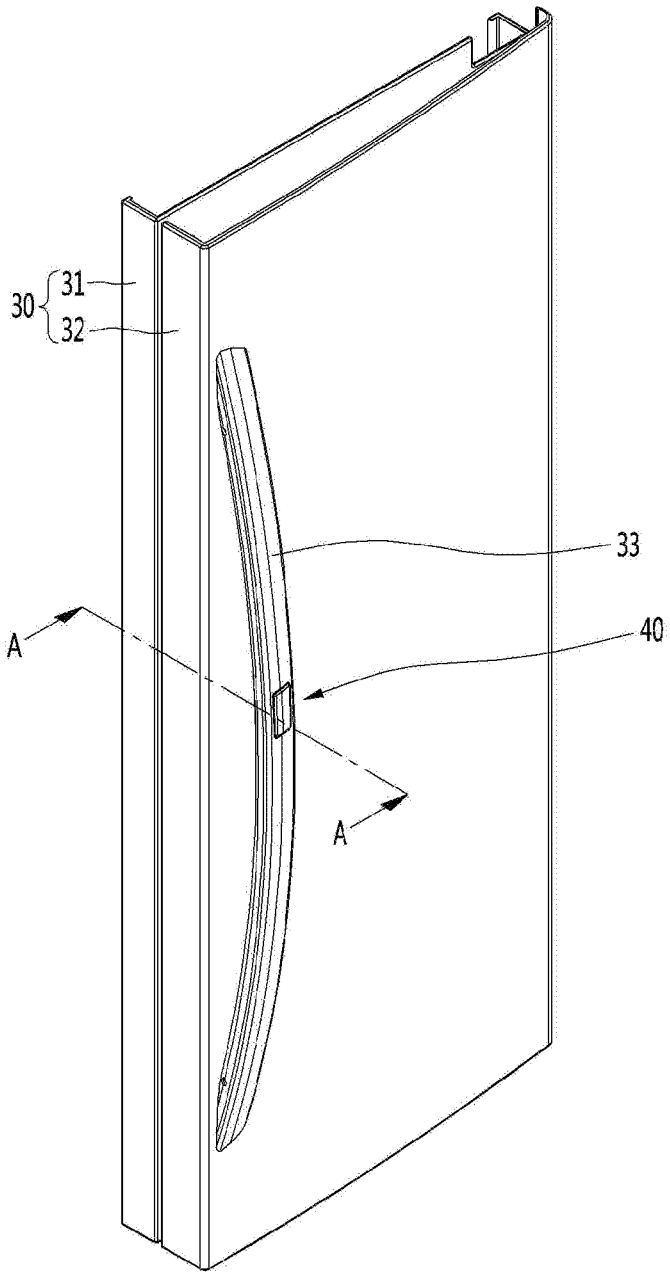
FIG. 2 is a perspective view of a refrigerating compartment door according to an embodiment of the present invention.
Figure 3:
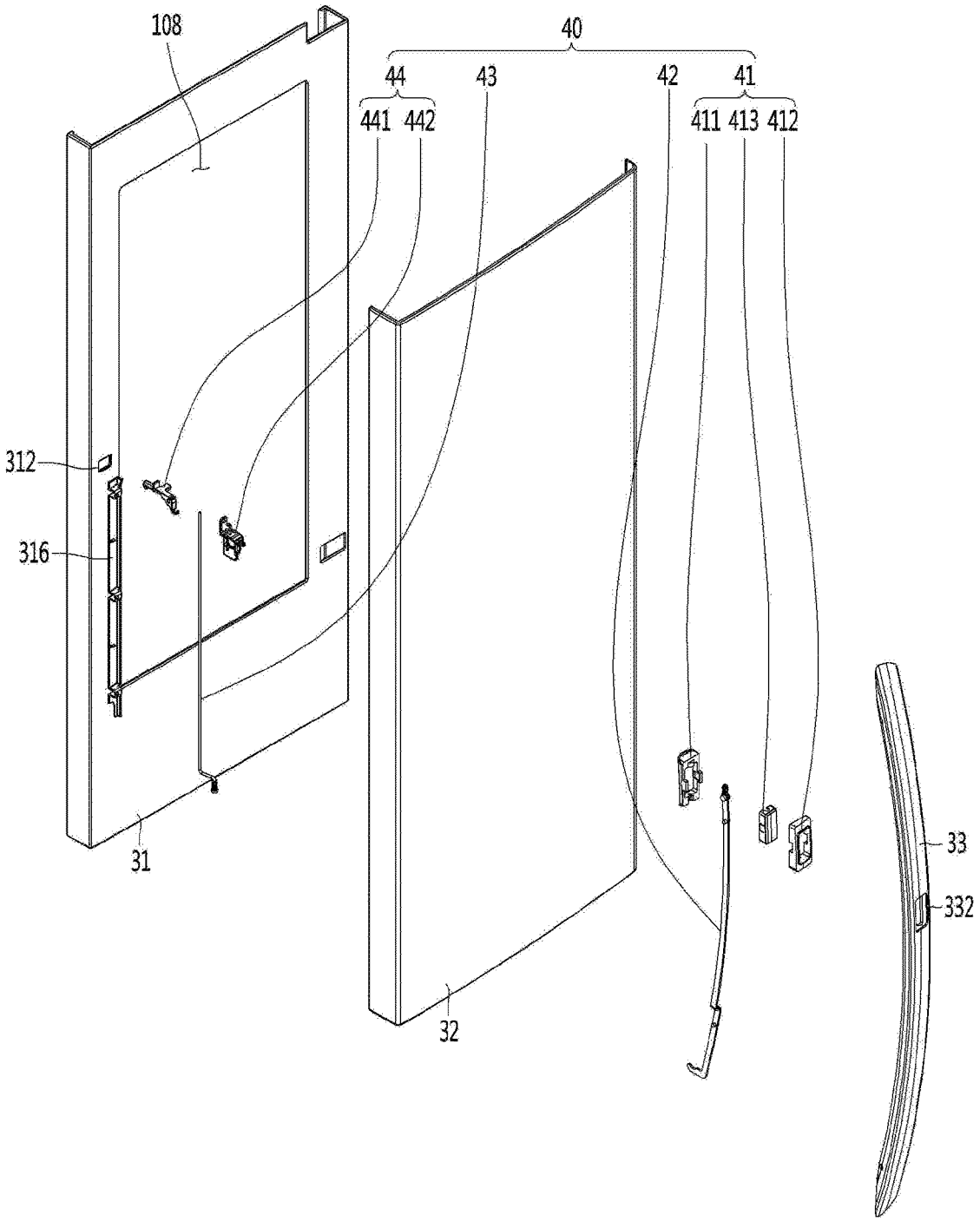
FIG. 3 is an exploded perspective view of the refrigerating compartment door.
Figure 4:
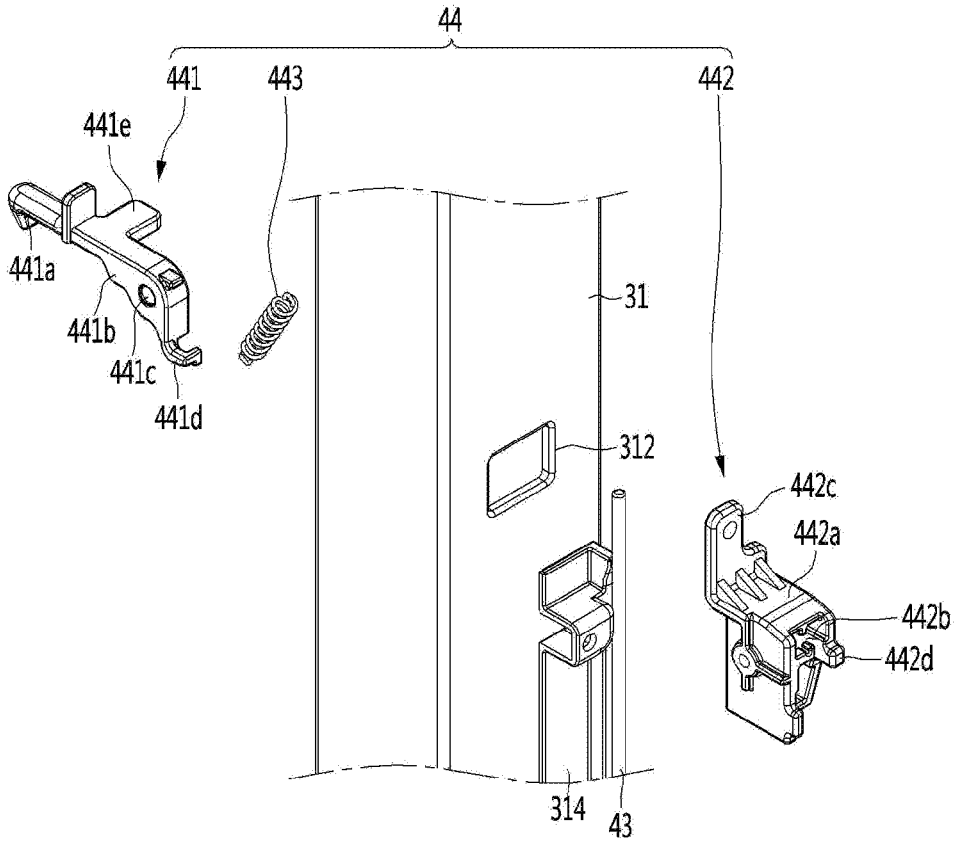
FIG. 4 is an exploded perspective view of a latch hook according to an embodiment of the present invention.
Figure 5:
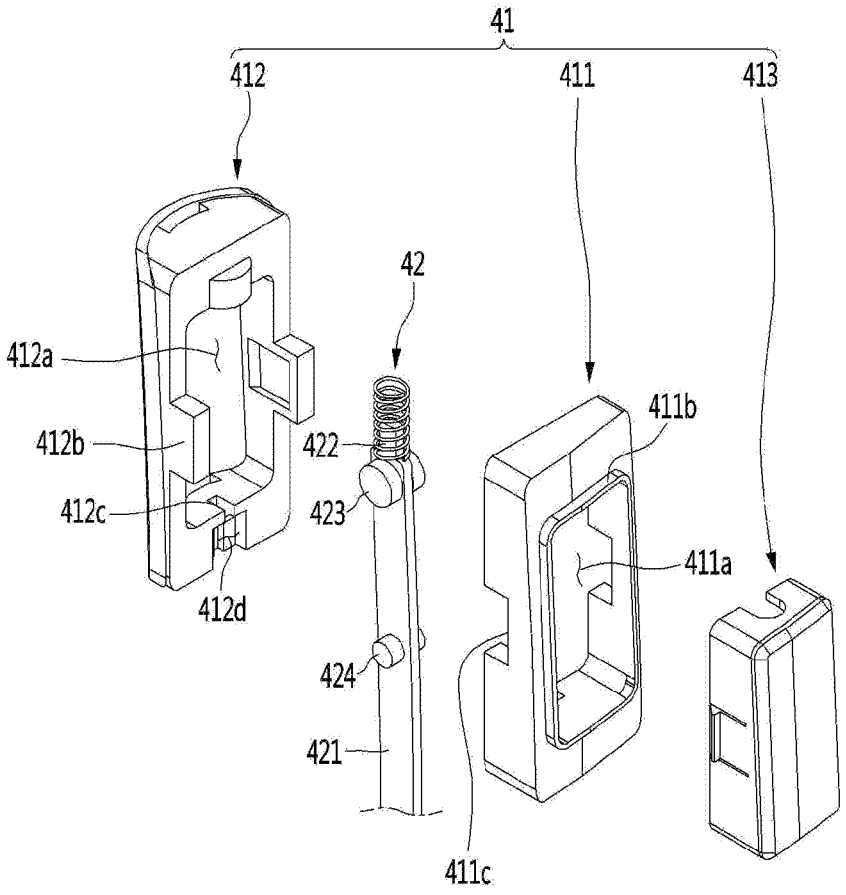
FIG. 5 is an exploded perspective view of a pressing portion according to an embodiment of the present invention.
Figure 6:
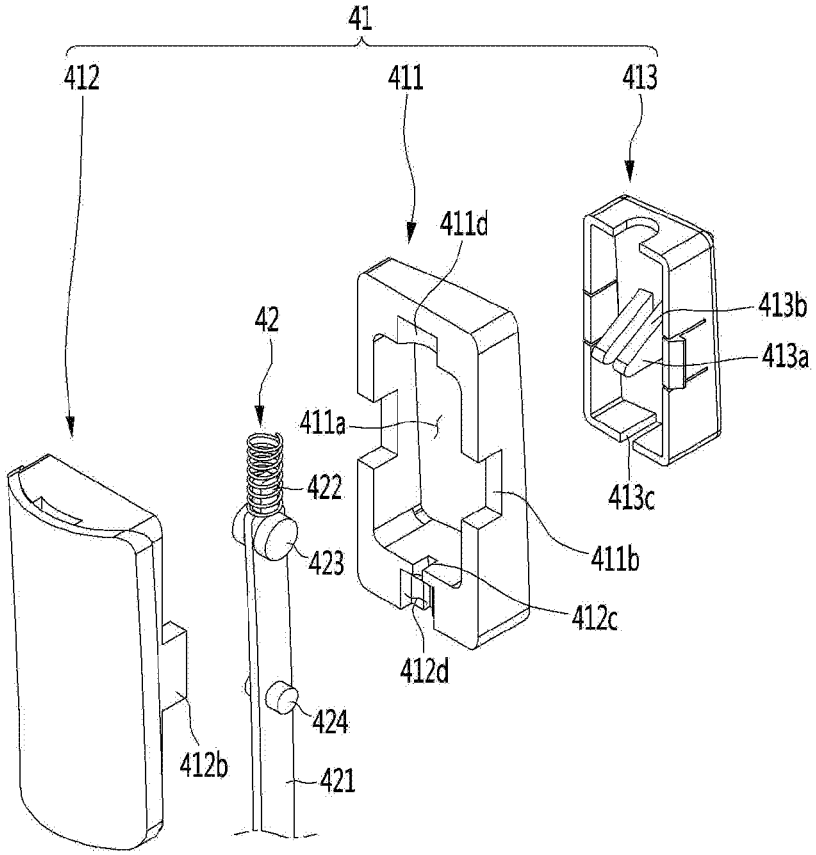
FIG. 6 is a view of the pressing portion of FIG. 5 when viewed in another direction.

FIG. 2 is a perspective view of the refrigerating compartment door according to the embodiment of the present invention, FIG. 3 is an exploded perspective view of the refrigerating compartment door, FIG. 4 is an exploded perspective view of the latch hook according to the embodiment of the present invention, FIG. 5 is an exploded perspective view of a pressing portion according to an embodiment of the present invention, and FIG. 6 is a view of the pressing portion of FIG. 5 when viewed in another direction.

Referring to FIGS. 2 to 6, the refrigerating compartment door 30 includes the first door 31 having the opening 108 formed in the front surface thereof and the second door 32 rotatably mounted on the front surface of the first door 31 to open or close the opening 108 of the first door 31.

The latch slot 312, into which the latch hook 44 is selectively fitted, is formed at one side of the opening 108 of the first door 31.

The refrigerating compartment door handle 33 for rotating the second door 32 is provided on the front surface of the second door 32, and the opening unit 40 for separating the latch hook 44 from the latch slot 312 is mounted at one side of the refrigerating compartment door handle 33.

Specifically, the refrigerating compartment door handle 33 is formed in a hollow shape, the opening unit 40 may be accommodated in the hollow space of the refrigerating compartment door handle 33. The opening unit 40 may be mounted in a mounting groove 332 formed by cutting a portion of the front surface of the refrigerating compartment door handle 33.

The opening unit 40 may include a pressing portion 41 pressed by the user, a first link 42 movable upward by operation of the pressing portion 41, a second link 43 moving upward according to upward movement of the first link 42, and the latch hook 44 separated from the latch slot 312 by upward movement of the second link 43. The first link 42 and the second link 43 may be defined as a link portion.

The latch hook 44 is fixed to the rear surface of the second door 32 and a portion thereof is hooked on the latch slot 312 of the first door 31.

Specifically, the latch hook 44 includes a hook guide 442 fixed to the rear surface of the second door 32 and a hook portion 441 hinged to the hook guide 442.

The hook guide 442 includes a body 442*a* forming a mounting space in which the hook portion 441 is rotatably mounted. The body 442*a* has a screw fastening portion 442*c* at an upper end thereof to be fixed to the rear surface of the second door 32 by a screw. In addition, a first spring coupling portion 442*d* is formed on the front end of the body 442*a*. The first spring coupling portion 442*d* is a portion, to which a torsion spring 443 connecting the hook portion 441 with the body 442*a* is coupled.

The hook portion 441 is mounted in the mounting space 442*b* formed by the hook guide 442 to be rotatable by a predetermined angle.

The hook portion 441 includes a hook member 441 inserted into and hooked on the latch slot 312. The end of the hook member 441*a* is hooked on the rear surface of the first door 31 after passing through the latch slot 312.

The hook portion 441 further includes a hinge portion 441*b* extending from the hook member 441*a* in a front end direction. A hinge shaft 441*c* is formed in the hinge portion 441*b*, such that the hook portion 441 rotates when the hook portion 441 is mounted in the mounting space 442*b* of the hook guide 442.

A second spring coupling portion 441*d* is formed on the lower side of the front end of the hinge portion 441*b*. The torsion spring 443 connecting the hook guide 442 with the hoop portion 441 is coupled to the second spring coupling portion 441*d*. That is, one end of the torsion spring 443 may be fixed to the first spring coupling portion 442*d* and the other end thereof may be coupled to the second spring coupling portion 441*d*.

By this structure, the hook portion 441 may be pressed downward by the torsion spring 443. Accordingly, in a state in which external force is not applied to the hook portion 441, the hook portion 441 may be inserted into and hooked on the latch slot 312.

Meanwhile, an extension 441*e* extending laterally may be formed on the hinge portion 441*b*. The extension 441*e* is pressed by the upper end of the second link 43 by moving the first link 42 and the second link 43 upward by operation of the pressing portion 41. The lower surface of the extension 441*e* may be in contact with the upper end of the second link 43.

The second link 43 is located below the extension 441*e*. The upper end of the second link 43 may be in contact with the lower end of the extension 441*e*, and a portion of the second link 43 may be supported by a support portion 341 formed on the front surface of the first door 31.

The support portion 314 is formed on the front surface of the first door 31 to be elongated in a vertical direction and may be in contact with a portion of the second link 43. Accordingly, when the second link 43 moves upward and downward as the first line 42 moves upward and downward, the second link 43 may move without shaking.

Although not shown, a support portion supporting upward and downward movement of the first link 42 may be formed on the first link 42. In this case, the support portion supporting the first link 42 may be provided inside the refrigerating compartment door handle 33.

Meanwhile, the pressing portion 41 is operated by the user in order to separate the latch hook 44 from the latch slot 312 to open the second door 32.

Specifically, the pressing portion 41 may include a first cover 411 mounted in the mounting groove 332, a second cover 412 coupled to the first cover 411 to form an accommodation space 412*a*, and a pressing member 413 mounted in the accommodation space 412*a* to move forward and backward. The first cover 411 and the second cover 412 may be defined as a pressing portion guide.

An opening 411*a* is formed in the first cover 411, and a protrusion 411*b* to be inserted into and coupled to the mounting groove 332 is formed on the edge of the opening 411*a*. Accordingly, the protrusion 411*b* may be inserted into the mounting groove 332, such that the first cover 411 is mounted in the refrigerating compartment door handle 33.

The first cover 411 may be coupled to the second cover 412 in concave and convex shapes. Fitting grooves 411*c* for coupling with the second cover 412 may be formed at both sides of the first cover 411 and fitting protrusions 412*b* fitted into the fitting grooves 411*c* may be formed in both sides of the second cover 411. Accordingly, the first cover 411 and the second cover 412 are coupled to each other to form the accommodation space 412*a* in which the pressing member 413 and the first link 42 are accommodated.

The second cover 412 is coupled with the first cover 411 to form the accommodation space 412*a*. In addition, the fitting protrusions 412*b* are formed on both sides of the second cover 412.

A slider mounting portion formed by coupling the second cover 412 with the first cover 411 is provided on the inner bottom surface of the second cover 412. The slider mounting portion may be formed in a shape corresponding to the first cover 411 and the second cover 412.

The slider mounting portion may include a slider slit 412*c*, into which the below-described first slider 412 is fitted, and a stopper groove 412*d* in which the below-described stopper protrusion 424 is accommodated.

The slider slit 412*c* and the stopper groove 412*d* may be formed in the rear surface of the lower end of the first cover 411 and the front surface of the lower end of the second cover 412, respectively. The slide slit 412*c* and the stopper groove 412*d* communicate with each other and may be formed by coupling between the first cover 411 and the second cover 412.

Meanwhile, the front surface of the pressing member 413 is pressed by the user to press the first link 42 accommodated in the accommodation space 412*a*. The front surface of the pressing member 413 may be exposed to the outside such that the pressing member 413 is easily pressed by the user. The pressing 413 may shield the first link 42 and the opening 411*a* of the first cover 411.

Specifically, the pressing member 413 is formed in a box form to open the rear surface thereof. The pressing member 413 may be mounted in the accommodation space 412*a* through the opening 411*a*, and a first elastic member (not shown) may be interposed between the inside of the pressing member 413 and the inside of the second cover 412. Accordingly, the pressing member 413 may be mounted to move forward and backward by the first elastic member.

Guide protrusions 413*a* protruding toward the first link 42 are formed on the rear surface of the pressing member 413. The guide protrusions 413*a* may form a pair.

Specifically, the guide protrusions 413*a* may include a first guide protrusion 413*a* and a second guide protrusion 413*a* formed at a point laterally spaced apart from the first guide protrusion, and each guide protrusion 413*a* includes an inclined surface 413*b*. The guide protrusions 413*a* may be formed to be inclined downward from the rear surface of the pressing member 413 to the first link 42.

The first link 42 may be movably fitted between the pair of guide protrusions 413*a*. At this time, a portion 413*c* of the lower surface of the pressing member 413 may be cut out, such that the first link 42 is inserted into the pressing member 413.

Meanwhile, the first link 42 is provided in the accommodation space 412*a* to be movable in a vertical direction.

Specifically, the first link 42 includes a first slider 421 elongated in the vertical direction. The first slider 421 is formed in a rod shape and a second elastic member 422 is wound on an end thereof. The second elastic member 422 may be mounted in a recessed portion 411*d* formed in the inner upper portion of the first cover 411. That is, one end of the second elastic member 422 may be coupled to the end of the first slider 421 and the other end thereof may be coupled to the inside of the recessed portion 411*d*, thereby elastically supporting the first slider 421, such that the first slider 421 moves in the vertical direction.

Contract portions 423 for allowing the first slider 421 to move in the vertical direction is formed on the upper portion of the first slider 421. The contact portions 423 may be formed on the first and second side surfaces of the first slider 421. The contact portions 423 have a circular cross section, without being limited thereto, and may have a triangular or rectangular shape.

The contact portions 423 are placed on the upper side of the guide protrusions 413*a* formed on the rear surface of the pressing member 413. That is, the contact portions 423 may be located at certain points of the inclined surfaces 413*b* of the guide protrusions 413*a*. Accordingly, the contact portions 423 may move in the vertical direction along the inclined surfaces 413*b* through line contact or surface contact with the inclined surfaces 413*b*.

Stopper protrusions 424 for restricting upward and downward movement of the first slider 421 may be further formed at the lower sides of the contact portions 423, that is, on the first and second side surfaces of the first slider 421. Accordingly, when the first slider 421 is inserted into the slider slit 412*c* to be mounted in the accommodation space 412*a*, the stopper protrusions 424 may be accommodated in the stopper groove 412*d*, thereby restricting upward and downward movement of the first slider 421.

Hereinafter, coupling relationship among the pressing portion, the link portion and the latch hook of the opening unit will be described in greater detail with reference to FIG. 7.

Figure 7:
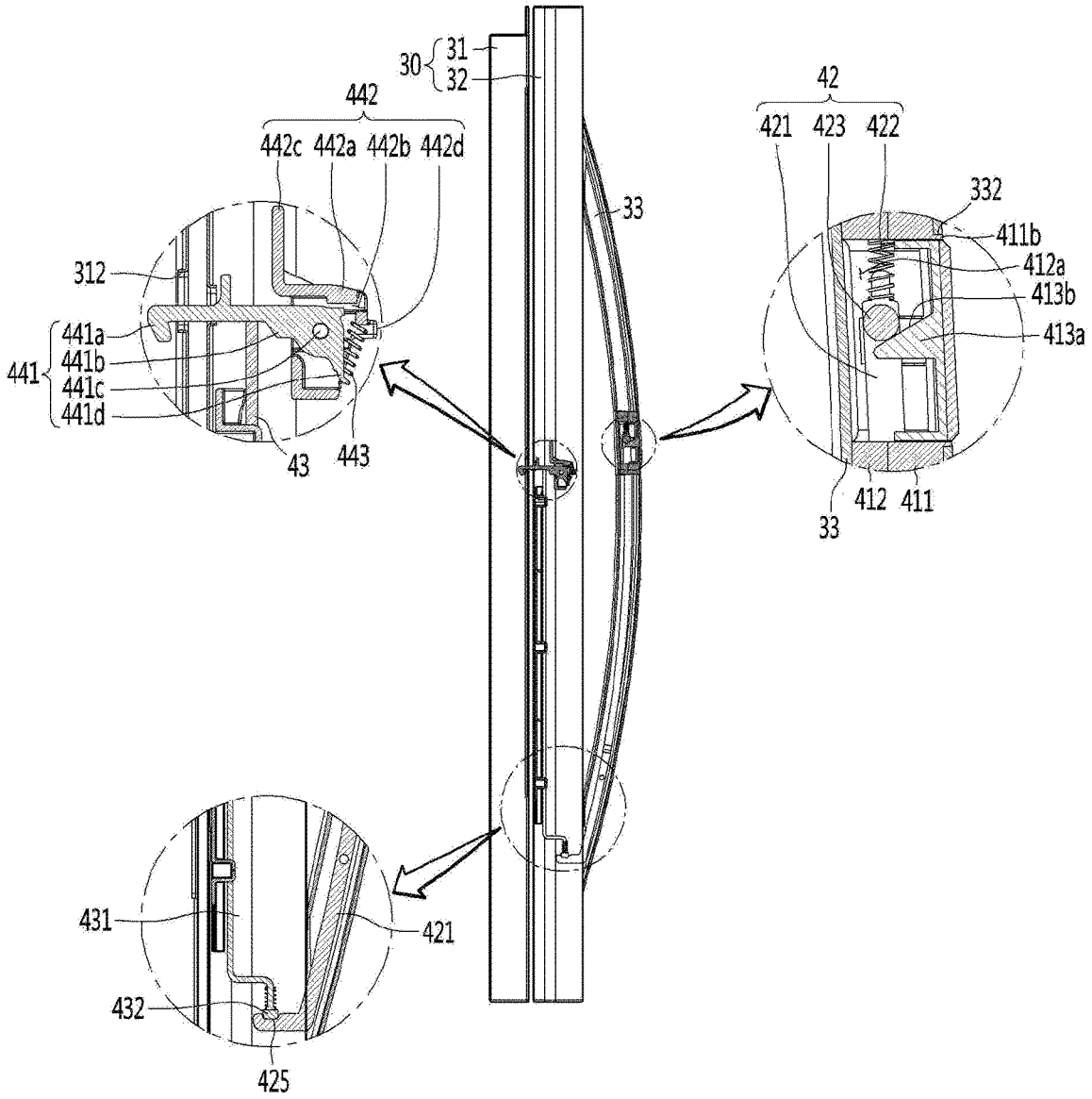
FIG. 7 is a longitudinal cross-sectional view taken along line A-A of FIG. 2.

FIG. 7 is a longitudinal cross-sectional view taken along line A-A of FIG. 2.

Referring to FIG. 7, the pressing portion 41 operated by the user is mounted in the mounting groove 332 formed in the outer surface of the refrigerating compartment door handle 33.

The cover 32 of the pressing portion 41 is fixed to the inside of the refrigerating compartment door handle 33, and the first link 42 is accommodated in the accommodation space 412*a* formed by coupling the second cover 32 and the first cover 31. In addition, the pressing member 413 is mounted to cover a portion of the first link 42 in the accommodation space. At this time, the first slider 421 of the first link 42 is fitted into the slider slit 412*c* formed by coupling the first cover 31 and the second cover 32, such that the first slider 421 is movable in the vertical direction.

In a state in which the first link 42 is fitted into the slider slit 412*c*, the pressing member 413 is mounted to be in contact with the first link 42.

Specifically, the pressing member 413 is mounted such that the first slider 421 is located between the pair of guide protrusions 413*a*. The pressing member 413 is mounted in the accommodation space 412*a* to be movable forward and backward (the left-and-right direction of FIG. 7)

At this time, the pair of contact portions 423 of the first link 42 are placed on the pair of guide protrusions 413*a*. That is, the pair of contact portions 423 is in contact with the inclined surfaces 413*b* of the pair of guide protrusions 413*a*. Accordingly, when the pressing member 413 is pushed backward (the left direction of FIG. 7), the contact portions 423 may move upward along the inclined surfaces 413*b* of the guide protrusions 413*a*.

Meanwhile, the end of the first slide 421 is connected to the second link 43.

Specifically, the second link 43 includes a second slider 431. One end of the second slider 431 is connected to the first slider 421. A link coupling portion 432 for coupling with the first slider 421 is formed on one end of the second slider 431, and a link coupling groove 425 for coupling with the second slider 431 is formed in the end of the first slider 421. Accordingly, the link coupling portion 432 is fitted into the link coupling groove 425, thereby moving the first slider 421 and the second slider 431 as one body.

In addition, the other end of the second slider 431 is in contact with the latch hook 44.

Specifically, the other end of the second slider 431 supports the bottom surface of the extension 441*e* of the latch hook 44. For example, when the first slider 421 moves upward by operation of the pressing portion 41, the second slider 431 connected to the first slider 421 moves upward to move the latch hook 44 to be separated from the latch slot 312. That is, when the second slider 431 presses the latch hook 44 upward, the latch hook 44 may rotate by the hinge portion 441*c* in a clockwise direction to be separated from the latch slot 312. At this time, the torsion spring 443 is pulled by rotation of the hinge portion 441*c*, thereby generating restoring force.

Hereinafter, a method of operating the opening unit will be described in detail with reference to the drawing.

Figure 8:
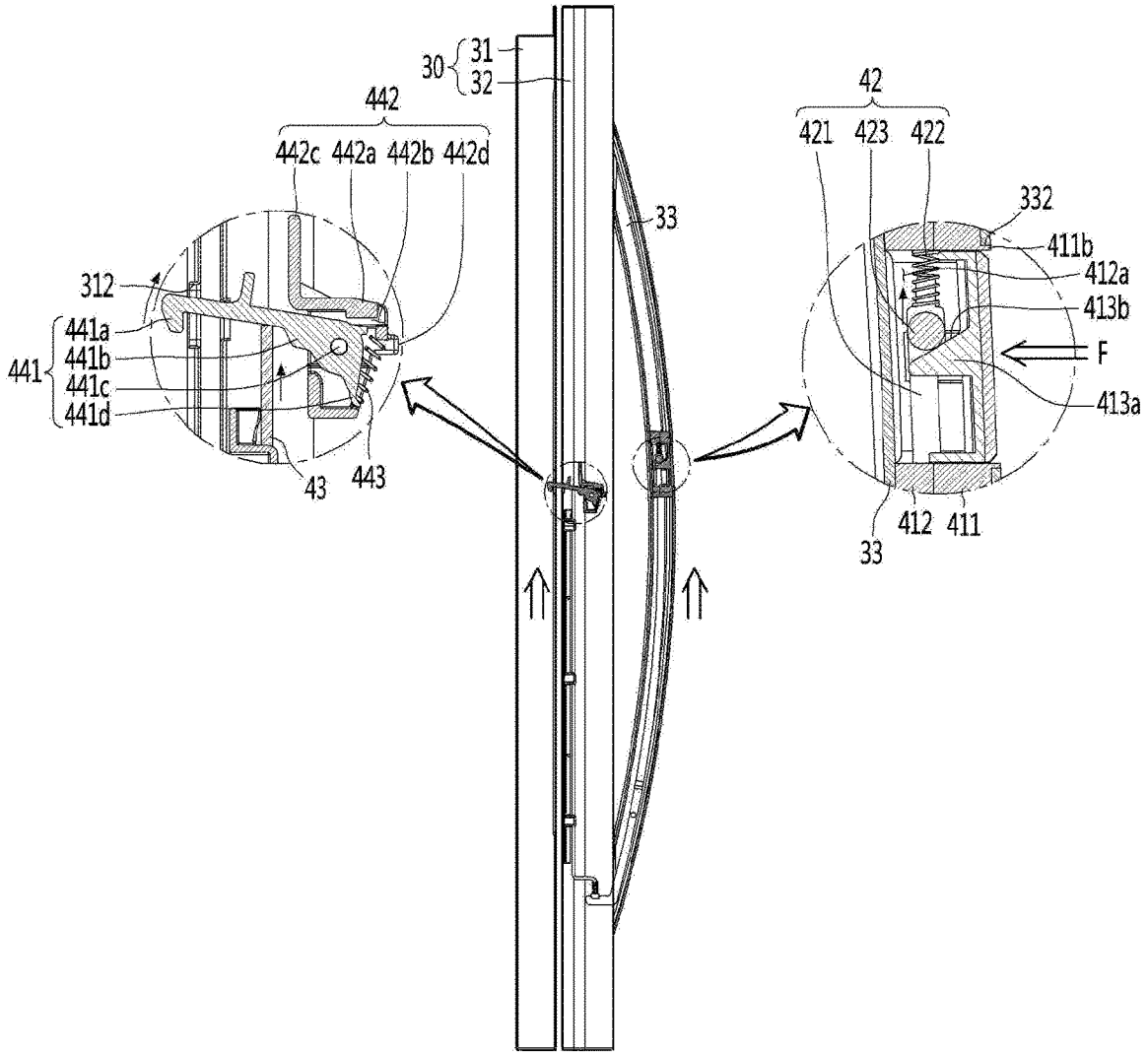
FIG. 8 is a view showing the state of the pressing portion and the latch hook when the pressing portion operates according to the embodiment of the present invention.

FIG. 8 is a view showing the state of the pressing portion and the latch hook when the pressing portion operates according to the embodiment of the present invention.

Referring to FIG. 8, the user may press the pressing member 413 of the pressing portion 41 in order to take out the food stored in the second storage compartment 106 in a state in which the first door 31 closes the first storage compartment 104. Then, the pressing member 413 moves toward the cabinet 10 and, at this time, the first link 42 contacting the guide protrusions 413*a* of the pressing member 413 moves upward along the inclined surfaces 413*b* of the guide protrusions 413*a*.

The second link 43 moves upward according to upward movement of the first link 42 and the upper end of the second link 43 presses the latch hook 44. As a result, the hinge portion 441*c* of the latch hook 44 rotates in a clockwise direction, and the hook portion 441*a* may be separated from the latch slot 312.

That is, when the user pulls the refrigerating compartment door handle 33 in a state of pressing the pressing member 413, the second door 32 is opened such that the food stored in the second storage compartment 106 may be taken out.

The invention claimed is:

1. A refrigerator comprising:

a cabinet that defines a first storage compartment;

a first door that is rotatably connected to the cabinet and that is configured to open and close at least a portion of the first storage compartment, the first door defining a latch slot;

a storage device that is disposed at a rear surface of the first door and that defines a second storage compartment;

a second door that is rotatably connected to a front surface of the first door, that is configured to open and close at least a portion of the second storage compartment, and that is configured to rotate relative to the first door;

a door handle disposed at a front surface of the second door; and an opening device that is configured to separate the second door from the first door, the opening device comprising:

a latch hook disposed at the second door and configured to insert into the latch slot, a pressing portion disposed at the door handle, the pressing portion comprising:

a pressing member having a front surface configured to be pressed by a user, the pressing member comprising a guide protrusion that protrudes rearward from a rear surface of the pressing member and that has an inclined surface, a first cover that defines an opening that accommodates the pressing member, and a second cover coupled to a rear surface of the first cover, and a link portion that connects the pressing portion to the latch hook, the link portion comprising:

a contact portion that is disposed at a first end of the link portion between the first cover and the second cover, that is configured to contact the inclined surface of the guide protrusion and to move upward and downward along the inclined surface of the guide protrusion, and that is configured to, based on the pressing portion being pressed, move upward along the inclined surface, and wherein a second end of the link portion is configured to contact the latch hook and is configured to, based on the contact portion moving upward along the inclined surface, push the latch hook upward to separate the latch hook from the latch slot.

2. The refrigerator according to claim 1, wherein the link portion comprises:

a first link that is disposed in the door handle and that includes the contact portion; and a second link that is disposed in the second door and that defines the second end of the link portion.

3. The refrigerator according to claim 2, wherein the first link and the second link are coupled to each other at a position inside the second door.

4. The refrigerator according to claim 2, wherein the guide protrusion comprises:

a first guide protrusion that protrudes rearward from the rear surface of the pressing member; and a second guide protrusion that protrudes rearward from the rear surface of the pressing member and that is laterally spaced apart from the first guide protrusion, and wherein the first link is disposed between the first guide protrusion and the second guide protrusion.

5. The refrigerator according to claim 4, wherein the contact portion comprises:

a first contact portion that is disposed on a first side surface of the first link and that is in contact with a first inclined surface of the first guide protrusion; and a second contact portion that is disposed on a second side surface of the first link and that is in contact with a second inclined surface of the second guide protrusion.

6. The refrigerator according to claim 1, wherein the latch hook comprises a hinge shaft and a hook portion that is configured to rotate about the hinge shaft.

7. The refrigerator according to claim 6, wherein the hook portion comprises:

a hinge portion that receives the hinge shaft and that defines a rotation center of the hinge shaft; and a hook member that is curved from an end of the hinge portion, that is spaced apart from the rotation center of the hinge shaft, and that is configured couple to the latch slot.

8. The refrigerator according to claim 7, wherein the hook portion comprises a contact point that is in contact with the second end of the link portion and that is spaced apart from the hinge shaft, and wherein the hook portion is configured to, based on the second end of the link portion pushing the contact point upward, rotate about the hinge shaft to separate the hook member from the latch slot.

9. The refrigerator according to claim 1, wherein the first cover defines a first stopper groove recessed from a rear surface of the first cover, wherein the second cover defines a second stopper groove recessed from a front surface of the second cover, and wherein each of the first stopper groove and the second stopper groove is configured to limit upward and downward movement of the link portion.

10. The refrigerator according to claim 9, wherein the link portion comprises a stopper protrusion that is disposed between the first stopper groove and the second stopper groove and that is configured to, based on the link portion moving upward, contact lower ends of the first cover and the second cover.

11. The refrigerator according to claim 1, wherein the door handle defines a mounting groove at a front surface of the door handle, the mounting groove accommodating at least a portion of the pressing member, and wherein the front surface of the pressing member is exposed to an outside through the mounting groove.

12. A refrigerator comprising:

a cabinet that defines a storage compartment;

a first door that is rotatably connected to the cabinet and that is configured to open and close at least a portion of the storage compartment, the first door defining a door opening and a latch slot that is spaced apart from the door opening;

a second door that is rotatably connected to a front surface of the first door, that is configured to open and close the door opening of the first door, and that is configured to rotate relative to the first door to open the door opening of the first door;

a door handle disposed at a front surface of the second door;

a pressing member disposed in the door handle and configured to move toward and away from the front surface of the second door;

a latch hook that is disposed between the first door and the second door and that is configured to couple to and release from the latch slot based on movement of the pressing member;

a first link that is disposed in the door handle, that extends downward from the pressing member, and that is configured to move upward based on the pressing member moving toward the front surface of the second door; and a second link that is disposed in the second door, that extends upward from a lower end of the first link, and that is configured to, based on the first link moving upward, move upward to push the latch hook to release the latch hook from the latch slot.

13. The refrigerator according to claim 12, wherein the first link and the door handle have a curved shape, and the first link extends downward along the door handle.

14. The refrigerator according to claim 12, wherein the latch hook comprises:

a hinge shaft disposed at one end of the latch hook; and a hook that is curved from another end of the latch hook; and wherein the latch hook is configured to, based on an upper end of the second link pushing a contact point between the hinge shaft and the hook in an upward direction, rotate about the hinge shaft to separate the hook from the latch slot.

15. The refrigerator according to claim 14, wherein the pressing member comprises a guide protrusion that protrudes rearward from a rear surface of the pressing member and that has an inclined surface, and wherein the first link comprises a contact protrusion that protrudes from a side surface of the first link and that is configured to contact and move along the inclined surface of the guide protrusion based on the pressing member moving toward the front surface of the second door.

16. The refrigerator according to claim 15, wherein the guide protrusion comprises:

a first guide protrusion having a first inclined surface; and a second guide protrusion that is laterally spaced apart from the first guide protrusion, the second guide protrusion having a second inclined surface, and wherein the first link is disposed between the first guide protrusion and the second guide protrusion.

17. The refrigerator according to claim 16, wherein the contact protrusion comprises:

a first contact protrusion that is disposed on a first side surface of the first link and that is in contact with the first inclined surface of the first guide protrusion; and a second contact protrusion that is disposed on a second side surface of the first link and that is in contact with the second inclined surface of the second guide protrusion.

18. The refrigerator according to claim 15, further comprising:

a first cover that is disposed in the door handle and that accommodates the pressing member; and a second cover that is disposed in the door handle and that is coupled to a rear surface of the first cover, wherein the first cover and the second cover define a space that accommodates an upper end of the first link.

19. The refrigerator according to claim 18, wherein the first link comprises a stopper protrusion that is disposed vertically below the contact protrusion and that is configured to, based on the first link moving upward, contact lower ends of the first cover and the second cover.

20. The refrigerator according to claim 12, further comprising an elastic member that is disposed at an upper end of the first link and that is configured to apply force downward based on the first link moving upward.

* * * * *